US010927699B2

(12) United States Patent
Bromann et al.

(10) Patent No.: US 10,927,699 B2
(45) Date of Patent: Feb. 23, 2021

(54) VARIABLE-PITCH BLADE CONTROL RING FOR A TURBOMACHINE

(71) Applicant: SAFRAN AIRCRAFT ENGINES, Paris (FR)

(72) Inventors: Alain Marc Lucien Bromann, Moissy-Cramayel (FR); Kamel Benderradji, Moissy-Cramayel (FR); Lilian Yann Dumas, Moissy-Cramayel (FR); Blaise Bergon, Moissy-Cramayel (FR); Suzanne Madeleine Coustillas, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 235 days.

(21) Appl. No.: 15/741,479

(22) PCT Filed: Jun. 27, 2016

(86) PCT No.: PCT/FR2016/051577

§ 371 (c)(1),
(2) Date: Jan. 2, 2018

(87) PCT Pub. No.: WO2017/006010

PCT Pub. Date: Jan. 12, 2017

(65) Prior Publication Data

US 2018/0371939 A1 Dec. 27, 2018

(30) Foreign Application Priority Data

Jul. 9, 2015 (FR) ..... 1556506

(51) Int. Cl.
*F01D 17/16* (2006.01)
*F04D 29/56* (2006.01)

(52) U.S. Cl.
CPC ..... *F01D 17/162* (2013.01); *F04D 29/563* (2013.01); *F05D 2260/30* (2013.01);
(Continued)

(58) Field of Classification Search
CPC ..... F01D 17/162; F01D 17/16; F04D 29/563; F05D 2260/30; F05D 2260/50;
(Continued)

(56) References Cited

U.S. PATENT DOCUMENTS 2,924,375 A 2/1960 McKissock
8,297,918 B2 * 10/2012 Bhatnagar ..... F04D 29/563 415/160

(Continued)

FOREIGN PATENT DOCUMENTS

| | | |
|---|---|---|
| EP | 1808579 | 7/2007 |
| FR | 2699595 | 6/1994 |
| GB | 2479064 | 9/2011 |

OTHER PUBLICATIONS

International Search Report with English Language Translation, dated Oct. 6, 2016, Application No. PCT/FR2016/051577.

*Primary Examiner* — Michael Lebentritt
*Assistant Examiner* — Eric J Zamora Alvarez
(74) *Attorney, Agent, or Firm* — Womble Bond Dickinson (US) LLP

(57) ABSTRACT

Variable-pitch blade control ring (44) for a turbine engine, including an annular body (42) configured to be mounted so as to be rotatable about an annular casing (16) of the turbine engine. The body links to levers (34) for connecting to the vanes. The ring has a mechanism for guiding in an axial and/or helical direction, supported by the body. The mechanism includes at least one substantially radial finger (60, 62) for axial abutment on at least one first surface (72, 74) of the casing and for sliding on the surface.

11 Claims, 3 Drawing Sheets

(52) U.S. Cl.
CPC ..... *F05D 2260/50* (2013.01); *F05D 2260/74* (2013.01); *F05D 2260/79* (2013.01)

(58) Field of Classification Search
CPC ..... F05D 2260/74; F05D 2260/79; F05D 2260/56; F05D 2230/64
See application file for complete search history.

(56) References Cited

U.S. PATENT DOCUMENTS

| | | | | |
|---|---|---|---|---|
| 8,714,916 | B2 * | 5/2014 | Jarrett, Jr. ..... | F01D 17/162 415/160 |
| 2005/0232757 | A1 * | 10/2005 | Bruce ..... | F01D 17/162 415/160 |
| 2013/0039735 | A1 * | 2/2013 | Eifert ..... | F01D 17/162 415/1 |
| 2013/0129487 | A1 * | 5/2013 | Colette ..... | F01D 17/162 415/148 |

* cited by examiner

VARIABLE-PITCH BLADE CONTROL RING FOR A TURBOMACHINE

TECHNICAL FIELD

The present invention relates to a variable-pitch vane control ring for a turbine engine.

PRIOR ART

The prior art particularly comprises documents FR-B1-2885968, FR-A1-2928979, GB-A-2479064, U.S. Pat. No. 2,924,375, EP-A2-1808579, FR-A1-2699595 and WO-A1-2009/133297.

In the present application, the (longitudinal) axis of a turbine engine is defined as being the axis of rotation of the one or more rotor(s) of its engine, and in particular the rotors of its low and high-pressure spools in the case of a twin-spool turbine engine. Terms such as internal, external, radial, axial, etc., refer to the position of a part relative to this axis.

The variable stator vanes (VSV) of a turbine engine are supported by an external annular casing, generally a compressor of the turbine engine. Each vane comprises a blade that is connected at the radially external end thereof to a radial cylindrical pivot that defines the axis of rotation of the vane and is rotationally guided in a corresponding opening of the external casing. The radially internal end of the blade of each vane generally comprises a second cylindrical pivot extending along the axis of rotation of the vane and being rotationally guided in an opening of an internal casing of the compressor.

The radially external end of the external pivot of each vane is connected by a lever to a control ring that is rotated about the external casing by an actuator or similar actuation means. A control ring comprises an annular body, the axis of revolution of which corresponds to the axis of the turbine engine. This body comprises means for linking to the aforementioned levers that generally comprise an annular row of substantially radial openings, which receive pins fixed to first ends of the levers. The second ends of the levers are fixed to the radially external pivots of the vanes. The rotation of the control ring is transferred by the levers to the external pivots of the vanes and causes them to rotate about the axes thereof. The ring can further comprise pads for centring and guiding the body in rotation about the axis of the turbine engine, which pads are supported by the body and cooperate by radial abutment with the casing.

The angular pitch of the stator vanes in a turbine engine is intended to adapt the geometry of the compressor to the operating point thereof and particularly to optimise the efficiency and the surge margin of this turbine engine and to reduce the fuel consumption thereof in the various flight configurations.

Each of these vanes can rotate about the axis thereof between a first "open" or "fully open" position, in which each vane extends substantially parallel to the longitudinal axis of the turbine engine, thus maximising the section for the passage of air, and a second "shut" or "almost shut" position, in which the vanes are inclined relative to the axis of the turbine engine and thus reduce the section for the passage of air through the vane stage.

A problem of axial warping of the ring has been observed during operation. In the present application, warping is understood to be an unwanted deformation of the ring. The axial warping of the ring is directly expressed by an angular pitch error and thus by incorrect positioning of the vanes.

The displacement law for the vanes is thus not met, which adversely impacts the aerodynamic performance of the system.

This phenomenon is particularly visible in the case of mono-actuator actuation means, i.e. when the ring is actuated by means of a single actuator. Warping of the ring is then observed, which is expressed by significant deformation of the ring in a zone diametrically opposite that which is connected to the actuator. This phenomenon is further compounded by the use of a casing made of a material having a high expansion rate. This type of casing expands very quickly under engine thrust. These high expansions are generally compensated by the use of a ring having a body made of aluminium. Aluminium, which deforms more than steel, accentuates the warping phenomenon.

The present invention proposes a solution to this problem of the prior art that is simple, effective and economical.

DISCLOSURE OF THE INVENTION

The invention proposes a variable-pitch vane control ring for a turbine engine, comprising:

- an annular body having an axis A of revolution and being configured to be mounted so as to be rotatable about said axis and an annular casing of the turbine engine, said body comprising means for linking to levers for connecting to said vanes, characterised in that it further comprises:
- first means for guiding in an axial and/or helical direction along said axis, which first means are supported by a first one of the elements selected from said body and said casing and comprise at least one finger that is substantially radial relative to said axis and that comprises axial abutment means configured to cooperate by (axial) abutment with at least one first surface of a second one of said elements and by sliding with said surface.

The ring according to the invention is thus configured to cooperate by axial abutment with the casing in order to limit or even prevent the aforementioned axial warping.

The ring according to the invention can comprise one or more of the following features, taken separately from each other or in combination with each other:

- the ring further comprises second means for centring and guiding the body in rotation about said axis, which second means are supported by said first element and comprise radial abutment means configured to cooperate by (radial) abutment with a second surface of said second element and by sliding with said surface;
- said axial abutment means comprise a bushing that is substantially radial relative to said axis;
- said finger comprises a substantially radial pin, which passes through an opening of said first element and the radially external end of which is threaded and receives a nut, and the radially internal end of which supports said bushing;
- said bushing is mounted so as to rotate freely on said radially internal end of the pin;
- said bushing comprises an annular collar at a radially external end; and
- the first element is said body and the second element is said casing.

The present invention further relates to a system for controlling variable-pitch vanes for a turbine engine, comprising an annular casing having an axis A of revolution, at least one ring as previously described mounted so as to be rotatable about said axis, and at least one annular row of variable-pitch vanes extending substantially radially relative to said axis and being connected to said body such that a rotation of the ring about the casing sets the vanes into rotation about substantially radial axes, characterised in that said casing comprises at least one groove for housing and guiding said at least one finger.

The cooperation of the finger of the ring with the groove of the casing allows the aforementioned axial warping to be limited or even prevented.

The system according to the invention can comprise one or more of the following features, taken separately from each other or in combination with each other:

said groove is formed in a boss of the casing;

said groove has a general shape of an arc of a circle;

said groove is delimited by two peripheral surfaces in cylinder portions that are configured to cooperate with said axial abutment means;

the system comprises means for actuating said at least one ring so as to rotate same about the casing, and wherein:

said actuation means comprise a single actuator, said finger and said groove being substantially diametrically opposite said actuator relative to said axis; or said actuation means comprise two actuators that are diametrically opposed relative to said axis, a first group of a finger and a groove being located halfway between the two actuators and being diametrically opposed to a second group of a finger and a groove relative to said axis;

said groove has a median radius that is substantially equal to the axial distance between a first transverse plane passing through said axes of rotation of the vanes and a second transverse plane passing through said finger.

The present invention further relates to a turbine engine, characterised in that it comprises at least one ring or one system as previously described.

DESCRIPTION OF THE DRAWINGS

The invention will be better understood, and further details, features and advantages of the invention will become clearer upon reading the following description, which is provided by way of non-limiting example, and with reference to the accompanying drawings, in which.

DETAILED DESCRIPTION

Figure 1:
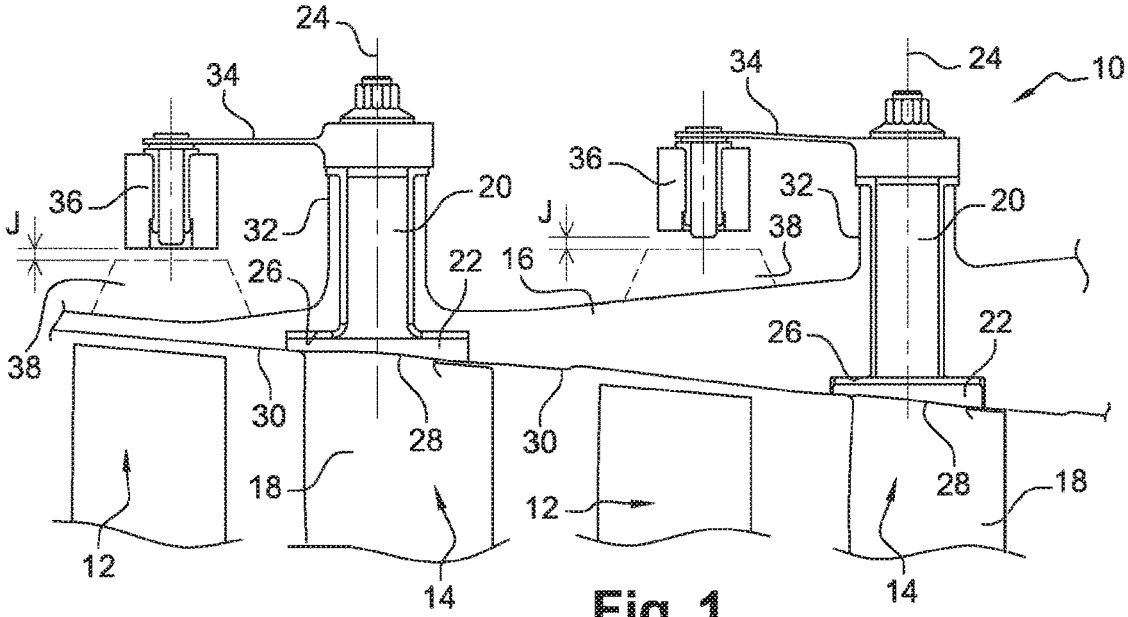
Fig. 1 PRIOR ART
FIG. 1 is a partial schematic half view in an axial section of a system for controlling variable-pitch vanes of a turbine engine according to the prior art.

FIG. 1 schematically shows, in an axial section, part of a high-pressure compressor 10 of a turbine engine, particularly an aircraft turbine engine, having several stages, each stage comprising an annular row of movable vanes 12 supported by the rotor (not shown) of the turbine engine and an annular row of fixed vanes 14 forming rectifiers supported by a casing 16 of the stator of the turbine engine, the angular orientation of the vanes 14 being adjustable in order to optimise the gas flow in the compressor 10.

Each vane 14 comprises a blade 18 and a radially external cylindrical pivot 20, connected by a disc or "plate" 22 extending perpendicularly to the axis 24 of the vane in a corresponding housing 26 of the casing 16. The radially internal surface 28 of the disc is aligned with the internal wall 30 of the casing so as not to oppose the gas flow.

In the prior art, the cylindrical pivot 20 of each vane 14 extends inside a radial cylindrical shaft 32 of the casing 16 and the radially external end thereof is connected by a lever 34 to a control ring 36, which surrounds the casing 16 and is connected to actuation means (not shown in FIG. 1) that allow it to rotate in one direction or in the other direction about the longitudinal axis of the casing 16 in order to set the vanes 14 of an annular row into rotation about the axes 24 thereof.

The vanes 14 can rotate about the axes 24 thereof between a position, called fully shut position, and a position, called fully open position.

In the fully shut position, the blades 18 of the vanes 14 are inclined relative to the longitudinal axis of the turbine engine, i.e. the chord of each vane (the line that connects the leading edge to the trailing edge) is substantially perpendicular to the longitudinal axis of the turbine engine. The blades 18 together define a minimum section for the passage of air in the duct. The vanes 14 are brought to this position when the turbine engine is at low speed or idling, the airflow flowing in the compressor then having a minimum value.

In the fully open position, the blades 18 of the vanes 14 extend substantially parallel to the axis of the turbine engine, i.e. the chord of each vane is substantially parallel to the longitudinal axis of the turbine engine. The section for the passage of air between the blades 18 is then maximal. The vanes 14 are brought to this position when the turbine engine is at full throttle, the airflow flowing in the compressor then having a maximum value.

The casing 16 can comprise, on the outer periphery thereof, projecting tracks 38, which are schematically shown in FIG. 1 by the broken lines, for centring and guiding the rings 36.

Figure 2:
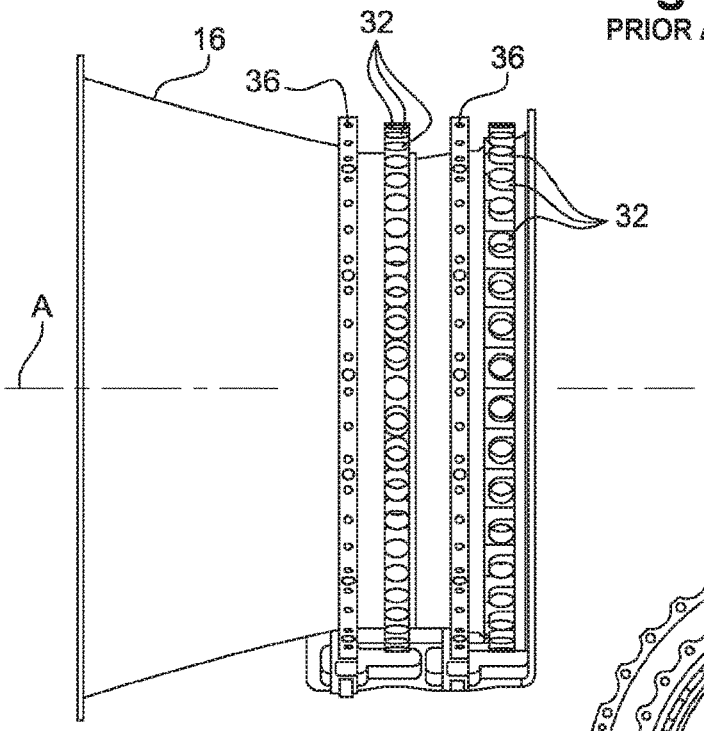
Fig. 2 PRIOR ART
FIGS. 2 and 3 are schematic perspective views of the casing of the system of FIG. 1, viewed from the side and from the front, respectively, from the downstream direction.
Figure 3:
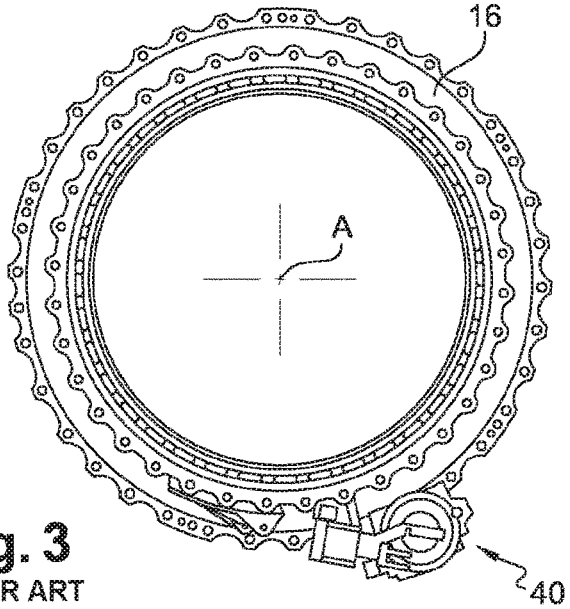
Fig. 3 PRIOR ART

The casing 16 supports the means 40 for actuating the rings 36. In the case shown in FIGS. 2 and 3, the actuation means comprise a (single) actuator 40, for example, a hydraulic actuator, comprising a body fixed to the casing 16 and a piston rod connected by suitable means to the rings 36. The actuator 40 in this case is mounted on the casing 16 so that its piston rod extends substantially parallel to an axis A of revolution of the casing 16, which is the axis of the turbine engine.

During operation, the actuator 40 retracts or deploys its piston rod, which sets the rings 36 into rotation about the casing 16 and the axis A. This rotation is accompanied by a slight axial displacement of the ring, which thus undergoes a substantially helical movement along the axis A. This axial displacement is imposed by the levers 34, which rotate about axes 24.

Figure 4:
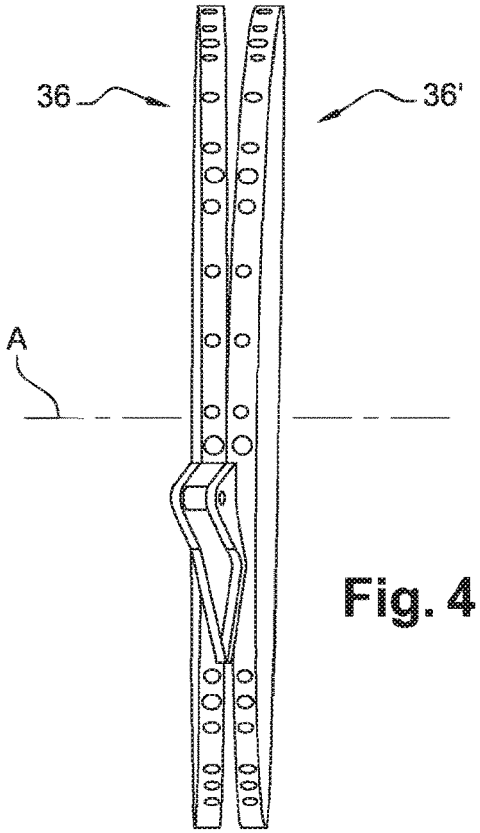
FIG. 4 is a schematic perspective view of a control ring without (left-hand side) and with (right-hand side) axial warping, respectively.

FIG. 4 shows, on the left-hand side of the drawing, a ring 36 in a free, unconstrained position. This ring 36 extends in a transverse plane, i.e. perpendicular to the axis A. FIG. 4 also shows, on the right-hand side of the drawing, a ring 36' that has experienced axial warping. This ring 36' no longer extends in a transverse plane. It is entirely warped.

The present invention allows this phenomenon to be limited or even prevented by virtue of a ring equipped with means for guiding in an axial and/or helical direction, which means comprise at least one substantially radial finger, and comprising means for axial abutment on at least one surface of the casing and for sliding on this surface.

Figure 5:
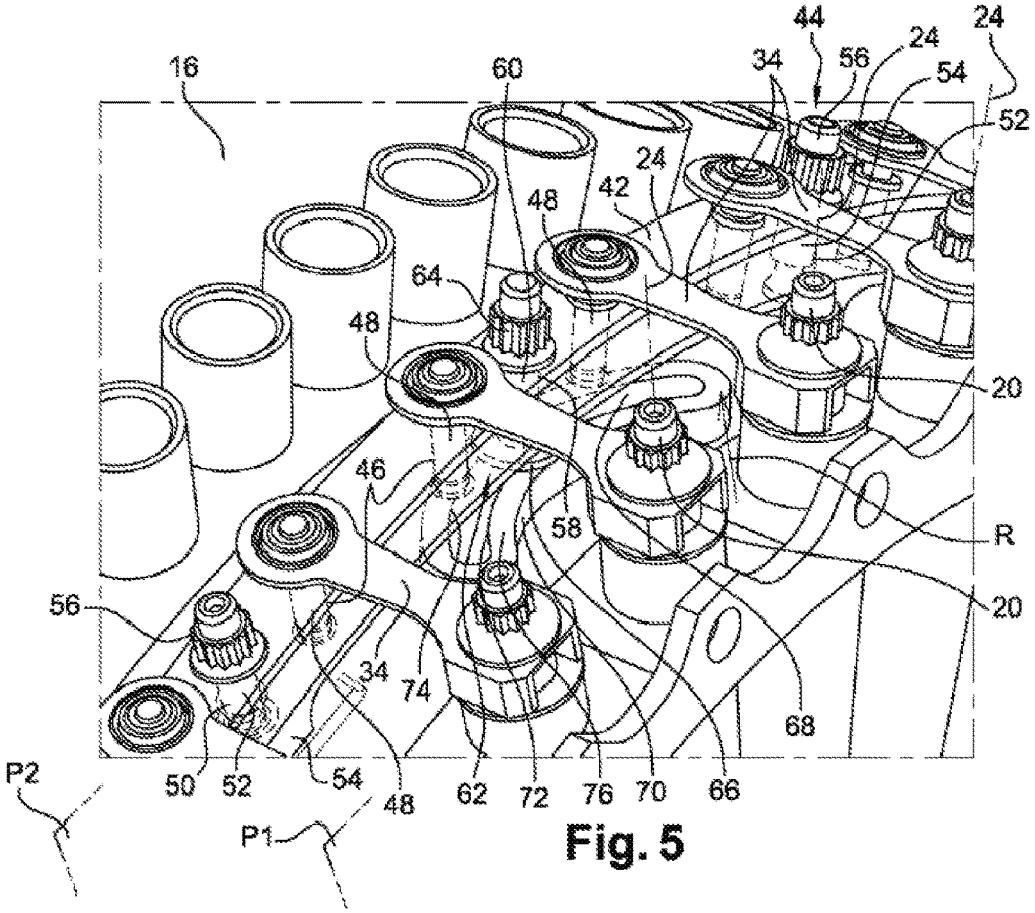
FIG. 5 is a partial schematic perspective view of a system for controlling variable-pitch vanes of a turbine engine according to the invention.
Figure 6:
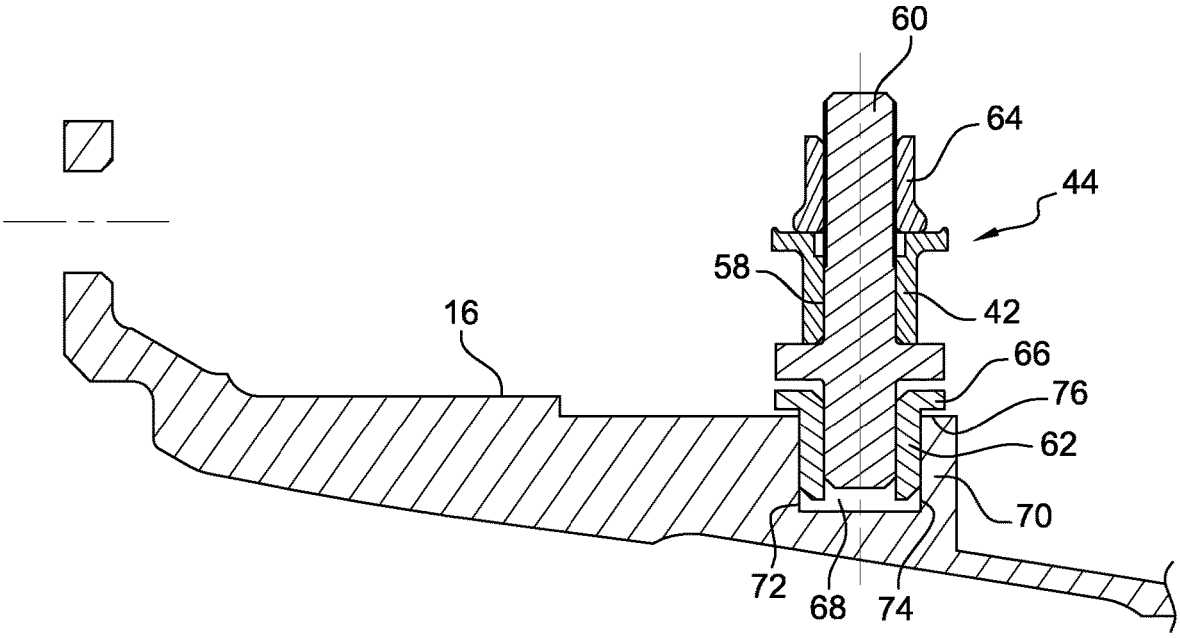
FIG. 6 is a schematic half view in an axial section of the system of FIG. 5.

In the embodiment of the invention shown in FIGS. 5 and 6, the body 42 of the ring 44 comprises:

first radial through-holes 46 for housing first cylindrical pins 48 supported by first ends of the levers 34, the second ends of which are mounted on the radially external pivots 20 of the vanes;

second radial through-holes 50 for housing second pins 52 for supporting pads 54, each pin 52 has a radial orientation and comprises a radially internal end that is connected to the pad 54 and a threaded radially external end that receives a nut 56 intended to come into abutment on the external periphery of the body 42, the pads 54 come into radial abutment on tracks of the casing 16, such as those 38 shown by the broken lines in FIG. 1; and third radial through-holes 58 for housing third pins 60 for supporting bushings 62, each pin 60 has a radial orientation and comprises a radially internal end that is connected to the bushing 62 and a threaded radially external end that receives a nut 64 intended to come into abutment on the external periphery of the body 42.

Each bushing 62, more visible in FIG. 6, has a general cylindrical shape and comprises an external annular collar 66 at its radially external end. Said bushing comprises a central bore, through which the radially internal end of the pin 60 passes. Said bushing is mounted on the pin 60 so as to be able to freely rotate about the axis of the pin. The assembly formed by the pin 60 and the bushing 62 forms the aforementioned finger.

Figure 7:
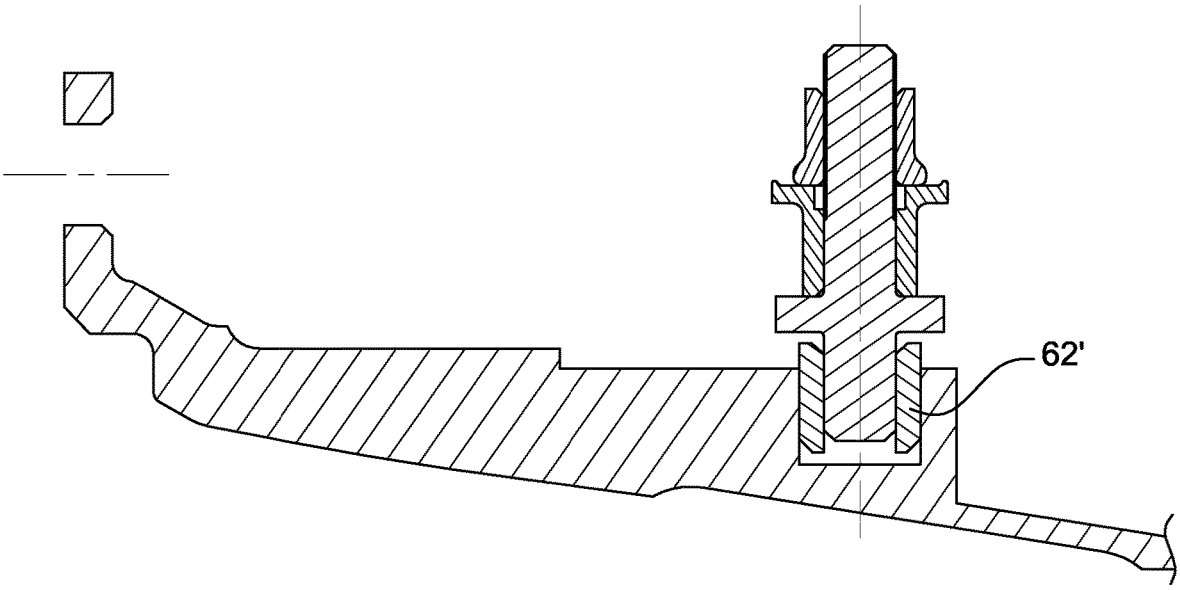
FIG. 7 is a view similar to that of FIG. 6 and showing a variant of an embodiment of the invention.

FIG. 7 shows a variant of an embodiment, in which the bushing 62' is devoid of a collar at its radially external end.

The bushing 62 is engaged in a groove 68 of the casing 16 that is in an arc of a circle. The groove 68 is formed in a boss 70 of the casing 16. Said groove emerges radially outwards and comprises two peripheral surfaces 72, 74 in cylinder portions and facing each other, on which surfaces the bushing 62 is able to cooperate by axial abutment and sliding. The surfaces 72, 74 extend around the same axis, which in this case is substantially located in the transverse plane P1 passing through the axes 24 of the vanes. The circumferential ends of the surfaces 72, 74 are connected to each other. The groove 68 has an angular extension around the aforementioned axis of approximately 30 to 60°. Said groove has a median radius R, measured between the aforementioned axis and an imaginary line passing through the centre of the groove (i.e. halfway between the surfaces 72, 74), which is substantially equal to the distance between the transverse plane P1 and the transverse plane P2 parallel to P1 and passing through the pins 60. This distance is substantially equal to the length of the active part of a lever 34, measured between the axis of the pin 48 of said lever and the axis of the pivot 20 of the vane to which said lever is connected.

The boss 70 comprises a radially external surface 76 defining a peripheral edge of the groove 68 and on which the collar 66 of the bushing can cooperate by abutment and/or by sliding.

In the aforementioned case where the means for actuating the ring 44 comprise a single actuator, the ring 44 can be equipped with a single finger or pin 60. The pin 60 and the groove 68 are preferably diametrically opposed relative to the actuator.

In the case where the actuation means comprise two diametrically opposed actuators, the ring 44 is preferably equipped with two diametrically opposed fingers or pins 60. The pins 60 and the actuators are preferably evenly distributed around the axis of the turbine engine, so as to provide an isostatic system.

During operation, the ring 44 is rotated about the casing 16 by actuating the one or more actuators. Said ring is centred and guided in rotation on the casing 16 by the pads 54 cooperating with the tracks 38 of the casing 16. The levers 34 rotate about axes 24 and force the ring 44 to be axially displaced over a given range of travel. Over this range of travel, the bushing 62 cooperates by abutment and by sliding with the surfaces 72, 74 of the groove 68 in order to prevent axial warping of the ring 44. The surfaces 72, 74 can comprise an anti-wear coating, for example, of the T800 type, in order to limit any friction with the bushing 62. The cooperation of the bushing 62 with the groove 68 does not prevent (and is not hindered by) the thermal expansion of the ring 44 and of the casing 16 during operation.

In the example shown in the drawings, the first and second elements as defined in the claims are the body of the ring and the casing, respectively. In a variant of an embodiment (not shown) the first and second elements as defined in the claims are the casing and the body of the ring, respectively. In other words, the one or more finger(s) are supported by the casing and cooperate by axial abutment with one or more groove(s) of the body of the ring.

The invention claimed is:

1. A variable-pitch vanes control ring for a turbine engine, comprising:

an annular body having an axis of revolution and being configured to be mounted so as to be rotatable about said axis and an annular casing of the turbine engine, said annular body comprising a first pin for each of the vanes, each first pin being configured to be linked to a lever which is connected to one of the vanes;

at least one finger configured to guide the annular body in at least one of an axial and a helical direction along said axis, said at least one finger being radial relative to said axis and supported by said annular body, said at least one finger comprising a radial pin which passes through an opening of said annular body, said at least one finger comprising a bushing radial relative to said axis, said bushing being configured to cooperate by axial abutment with at least one first surface of said casing and by sliding with said at least one first surface.

2. The ring according to claim 1, wherein the ring further comprises at least one second pin configured to center and guide the annular body in rotation about said axis, said at least one second pin being supported by said annular body, said at least one second pin supporting a pad, said pad being configured to cooperate by radial abutment with a second surface of said casing and by sliding with said second surface.

3. The ring according to claim 1, wherein a radial external end of said radial pin threaded and receives a nut, and a radially internal end of said radial pin supports said bushing.

4. The ring according to claim 3, wherein said bushing is mounted so as to rotate freely on said radially internal end said radial pin.

5. The ring according to claim 1, wherein said bushing comprises an annular collar at a radially external end.

6. A system for controlling variable-pitch vanes for a turbine engine, comprising said at least one variable-pitch vanes control ring according to claim 1 mounted so as to rotate about said axis and said casing, and at least one annular row of variable-pitch vanes extending radially relative to said axis and being connected to said annular body so that a rotation of the at least one ring about the casing sets the variable-pitch vanes into rotation about corresponding radial axes for each vane, wherein said casing comprises at least one groove for housing and guiding said at least one finger.

7. The system according to claim 6, wherein said groove is formed in a boss of the casing.

8. The system according to claim 6, wherein said groove has a shape of an arc of a circle and is delimited by two peripheral surfaces in cylinder portions that are configured to cooperate with said bushing.

9. The system according to claim 6, wherein the system comprises means for actuating said at least one ring so as to rotate same about the casing, said means for actuating comprise a single actuator, said finger and said groove being diametrically opposite said actuator relative to said axis.

10. The system according to claim 6, wherein said groove has a median radius that is equal to an axial distance between a first transverse plane passing through said axes of rotation of the vanes and a second transverse plane passing through said finger.

11. A turbine engine for an aircraft, including at least one variable-pitch vane control ring comprising:

an annular body having an axis of revolution and being configured to be mounted so as to be rotatable about said axis and an annular casing of the turbine engine, said annular body comprising a first pin for each of the vanes, each first pin being configured to be linked to a lever which is connected to one of the vanes;

at least one finger configured to guide the annular body in at least one of an axial and a helical direction along said axis, said at least one finger being radial relative to said axis and supported by said annular body, said at least one finger comprising a radial pin which passes through an opening of said annular body, said at least one finger comprising a bushing radial relative to said axis, said bushing being configured to cooperate by axial abutment with at least one first surface of said casing and by sliding with said at least one first surface.

* * * * *